US006210222B1

(12) United States Patent
Langham et al.

(10) Patent No.: US 6,210,222 B1
(45) Date of Patent: Apr. 3, 2001

(54) COAXIAL CABLE CONNECTOR

(75) Inventors: Arvin L. Langham; William D. McLaughlin; Gary L. Harrison, all of Syracuse, NY (US)

(73) Assignee: Eagle Comtronics, Inc., Clay, NY (US)

( * ) Notice: Subject to any disclaimer, the term of this patent is extended or adjusted under 35 U.S.C. 154(b) by 0 days.

(21) Appl. No.: 09/460,258

(22) Filed: Dec. 13, 1999

(51) Int. Cl.[7] ..... H01R 9/05

(52) U.S. Cl. ..... 439/583; 439/578

(58) Field of Search ..... 439/322, 578, 439/583, 584

(56) References Cited

U.S. PATENT DOCUMENTS

| | | |
|---|---|---|
| 4,053,200 | 10/1977 | Pugner . |
| 4,059,330 | 11/1977 | Shirey . |
| 4,126,372 | 11/1978 | Hashimoto et al. . |
| 4,131,332 | 12/1978 | Hogendobler et al. . |
| 4,135,776 | 1/1979 | Ailawadhi et al. . |
| 4,155,619 | 5/1979 | Bray et al. . |
| 4,156,554 | 5/1979 | Aujla . |
| 4,346,958 | 8/1982 | Blanchard . |
| 4,400,050 | 8/1983 | Hayward . |
| 4,408,822 | 10/1983 | Nikitas . |
| 4,421,377 | 12/1983 | Spinner . |
| 4,548,453 | 10/1985 | Mummey et al. . |
| 4,583,809 | 4/1986 | Werth et al. . |
| 4,583,811 | 4/1986 | McMills . |
| 4,596,434 | 6/1986 | Saba et al. . |
| 4,624,520 | 11/1986 | Blum . |
| 4,662,693 | 5/1987 | Hutter et al. . |
| 4,668,043 | 5/1987 | Saba et al. . |
| 4,761,146 | 8/1988 | Sohoel . |
| 4,808,121 | 2/1989 | Smrekar . |
| 4,808,124 | 2/1989 | Spinner et al. . |
| 4,834,675 | 5/1989 | Samchisen . |
| 4,834,676 | 5/1989 | Tackett . |
| 4,842,553 | 6/1989 | Ingram . |
| 4,902,246 | 2/1990 | Samchisen . |
| 4,904,207 | 2/1990 | Smith et al. . |
| 4,917,631 | 4/1990 | Souders et al. . |
| 4,990,106 | 2/1991 | Szegda . |
| 5,002,503 | 3/1991 | Campbell et al. . |
| 5,007,861 | 4/1991 | Stirling . |
| 5,011,432 | 4/1991 | Sucht et al. . |
| 5,021,010 | 6/1991 | Wright . |
| 5,024,606 | 6/1991 | Ming-Hwa . |
| 5,066,248 | 11/1991 | Gaver, Jr. et al. . |
| 5,073,129 | 12/1991 | Szegda . |
| 5,083,943 | 1/1992 | Tarrant . |
| 5,127,853 | 7/1992 | McMills et al. . |
| 5,137,471 | 8/1992 | Verespej et al. . |
| 5,141,451 | 8/1992 | Down . |
| 5,183,411 | 2/1993 | Yu . |
| 5,183,412 | 2/1993 | Nagafuji . |
| 5,184,965 | 2/1993 | Myschik et al. . |
| 5,186,655 | 2/1993 | Glenday et al. . |
| 5,195,906 | 3/1993 | Szegda . |
| 5,217,393 | 6/1993 | Del Negro et al. . |
| 5,269,701 | 12/1993 | Leibfried, Jr. . |
| 5,281,167 | 1/1994 | Le et al. . |
| 5,295,864 | 3/1994 | Birch et al. . |

(List continued on next page.)

*Primary Examiner*—Brian Sircus
*Assistant Examiner*—Thanh-Tam Le
(74) *Attorney, Agent, or Firm*—Burr & Brown

(57) ABSTRACT

A F-type coaxial cable connector includes an outer tubular sleeve which receives an inner tubular post. The inner post includes a projecting barrel portion sized to receive the center conductor and the dielectric layer of a prepared coaxial cable end. The barrel portion includes a raised barb which separates the outer jacket and conductive braid or foil of the coaxial cable, the post further including an annular flange having a circumferential cavity which receives the end of the separated cable jacket and braid, providing a 360° seal. The post and rotating nut are driven longitudinally into the stationary outer sleeve to crimp the connector and to complete the cable termination.

26 Claims, 7 Drawing Sheets

U.S. PATENT DOCUMENTS

| | | | | |
|---|---|---|---|---|
| 5,342,218 | | 8/1994 | McMills et al. . | |
| 5,393,244 | | 2/1995 | Szegda . | |
| 5,435,745 | | 7/1995 | Booth . | |
| 5,456,614 | | 10/1995 | Szegda . | |
| 5,466,173 | | 11/1995 | Down . | |
| 5,470,257 | | 11/1995 | Szegda . | |
| 5,498,176 | | 3/1996 | Hashizawa et al. . | |
| 5,499,934 | | 3/1996 | Jacobsen et al. . | |
| 5,501,616 | | 3/1996 | Holliday . | |
| 5,525,076 | | 6/1996 | Down . | |
| 5,571,028 | * | 11/1996 | Szegda | 439/322 |
| 5,607,320 | | 3/1997 | Wright . | |
| 5,607,325 | | 3/1997 | Toma . | |
| 5,609,501 | | 3/1997 | McMills et al. . | |
| 5,620,339 | | 4/1997 | Gray et al. . | |
| 5,632,651 | | 5/1997 | Szegda . | |
| 5,645,450 | | 7/1997 | Yamada et al. . | |
| 5,651,698 | | 7/1997 | Locati . | |
| 5,651,699 | | 7/1997 | Holliday . | |
| 5,667,405 | | 9/1997 | Holliday . | |
| 5,863,220 | | 1/1999 | Holliday . | |
| 5,879,191 | | 3/1999 | Burris . | |
| 5,888,094 | * | 3/1999 | Kubota et al. | 439/583 |
| 5,938,474 | * | 8/1999 | Nelson | 439/583 |
| 5,975,951 | * | 11/1999 | Burris et al. | 439/585 |
| 6,027,373 | * | 2/2000 | Gray et al. | 439/578 |
| 6,032,358 | * | 3/2000 | Wild | 29/863 |
| 6,033,260 | * | 3/2000 | Murata et al. | 439/578 |
| 6,053,769 | * | 4/2000 | Kubota et al. | 439/578 |

* cited by examiner

COAXIAL CABLE CONNECTOR

FIELD OF THE INVENTION

The invention is related to the field of telecommunications and coaxial cable connectors, and more particularly to a one piece F connector which maintains a mechanical and fully shielded electrical connection with a coaxial cable end, while also providing a substantial RF and moisture seal.

BACKGROUND OF THE INVENTION

Conventional coaxial cables for the cable television industry, such as those shown in FIG. 6, typically include a circular center electrical conductor surrounded by a plastic or foam dielectric insulating layer of substantially constant thickness which forms an annular ring around the center electrical conductor. The outer surface of the dielectric insulating layer is covered by an outer conductor, usually an electrically conductive foil or braid or both of a material such as aluminum, and finally an outer elastomeric jacket surrounds the outer conductor.

So-called "F"-type connectors have historically been utilized to terminate the above types of coaxial cables in order to provide a continuous relationship between the center electrical conductor and the conductive foil or braid (or both) in order to effectively transmit a signal without leakage or loss of signal due to the connector and coaxial cable termination devices. F-connectors can include two, three, four, or more pieces, which are assembled together to retain a cable end. A key feature of some, is a hollow post positioned within a metal sleeve, the hollow post including a barrel portion having a raised barb. The barrel portion has a diameter which is slightly larger than the diameter of the inner dielectric insulating layer such that a prepared cable end having an exposed dielectric layer and center conductor can be positioned within the interior of the barrel. The cable is then compressed to complete the connection.

Several different methods have been employed historically to terminate the cable and complete the above assembly. Each of these methods have inherent problems. For example, one common termination method is to radially crimp the metal sleeve onto the post and barb using a hex-shaped tool. Using this method, six indents are formed, creating gaps in 60 degree intervals between the connector body and the jacket of the coaxial cable. These gaps potentially allow moisture into the connector and cause potential distortion of the coaxial cable. Moisture produces corrosion, effectively reducing signal strength and increasing resistance between the coaxial cable and the connector. In addition, because the afore mentioned leakage termination paths, RF leakage can also invariably occur between the connector and the coaxial cable's inner conductive braid shield.

Rather than using a radial crimping method for securing the coaxial cable to the connector, other F connector types use varied techniques using axial forces. For example, the EZ-F type connector manufactured by Raychem Corporation includes a compression sleeve, made from plastic or metal, in combination with the post, a retaining nut, and an outer sleeve. The compression sleeve is disposed between the post and the retaining nut and is caused to plastically deform into an open annular space defined in the post by application of an axial or longitudinal tool.

In another form of longitudinal crimp cable connector, described in U.S. Pat. No. 5,002,503, a preassembled nut, collar, and post are used in conjunction with an axially movable sleeve which fits within the open end of the collar to create a tight mechanical connection. In all known connectors which utilize longitudinal termination (e.g. use a longitudinal compression tool for termination thereof), the portion of the connector having the rotating nut is held in a stationary position and the portion of the connector body or sleeve accepting the coaxial cable moves axially in a direction toward the rotating nut of the connector. Besides the additional costs associated in the manufacture and assembly of these types of connectors, there are also leakage effects due to loosening of the connector and the cable end given that the forces are applied in the same direction as the assembly of the cable.

SUMMARY OF THE INVENTION

A primary object of the present invention is to overcome the above noted problems of the prior art.

Another primary object of the present invention is to provide a coaxial cable connector which provides a substantial mechanical fit between a coaxial cable and the connector while providing good electrical interconnection between the coaxial cable shielding conductor and the coaxial cable connector with minimal leakage.

Yet another primary object of the present invention is to provide an F coaxial cable connector which is adaptable for both environmental as well as non-environmental uses.

Therefore and according to a preferred aspect of the invention, there is provided a longitudinally compressed coaxial cable connector used for terminating a drop end of a coaxial cable, said coaxial cable including a center electrical conductor, a dielectric layer surrounding said center electrical conductor, a conductive layer surrounding said dielectric layer, and an outer insulating layer, said connector comprising:

an outer tubular sleeve having opposing first and second ends;

an inner post press fitted into one of the ends of said outer tubular sleeve, said inner hollow post comprising an annular flange and an extending barrel portion sized for receiving the dielectric layer and center electrical conductor of a prepared cable end inserted into the other end of said outer tubular sleeve, said barrel portion including a raised barb for separating the conductive layer and the outer insulating layer of the inserted cable end; and a rotating nut member attached to said inner post, said rotating nut member having an internal threaded portion for receiving input from a cable termination device, and in which said inner post and said rotating nut are movable within the interior of said outer tubular sleeve toward the cable receiving end of the outer tubular sleeve to crimp the inserted cable end and to complete the termination thereof.

According to another preferred aspect of the present invention, there is provided a longitudinally compressed cable connector for terminating a drop end of a coaxial cable, said connector comprising: an outer tubular sleeve having opposing first and second ends; a hollow inner post pressfitted into one of the ends of the outer tubular sleeve, said inner post comprising an annular flange and an extending barrel portion having a diameter sized for receiving a portion of a prepared coaxial cable end inserted into the opposing end of said tubular sleeve, said barrel portion having means for separating portions of said coaxial cable; and a rotating nut fixedly attached to said inner post, said rotating nut having an internal threaded portion for receiving input from a cable termination device wherein said rotating nut and inner post are capable of axial movement in a direction directed toward the cable receiving end of the outer tubular sleeve, said sleeve being stationarily held after insertion of said cable end and in which said outer tubular sleeve includes an opening at the cable receiving end, said opening having a throat for compressing said inserted cable end.

According to yet another preferred aspect of the present invention there is provided a method of terminating a coaxial cable using an F connector, said F connector having an inner post fitted within an outer tubular sleeve, said method comprising the steps of:

i) preparing one end of a coaxial cable by removing an axial portion of at least one outer layer of said cable;

ii) inserting the prepared coaxial cable end into said cable connector wherein insertion causes the axially separated portion to extend through an axial sleeve and separates the outer portion of the remainder of the cable inserted into the connector;

iii) driving said cable until the separated ends of said coaxial cable are placed into a circumferential sealing recess; and iv) supporting said sleeve in a stationary position and axially driving the post and rotating nut toward said supported sleeve in order to crimp the cable.

According to yet another preferred aspect of the present invention, there is provided an assembly comprising a coaxial cable and a cable connector, said coaxial cable including:

a center conductor;

an inner insulating layer surrounding said center conductor;

at least one outer conductive layer surrounding said inner insulating layer; and an outer insulating jacket surrounding said at least one outer conductive layer, said cable connector comprising:

an outer tubular sleeve;

an hollow inner post pressfitted said outer tubular sleeve, said hollow inner post having an annular flange and a distal barrel portion extending from said annular flange having a diameter which is smaller than the diameter of the inner conductive layer, said distal barrel portion further having a raised barb on an exterior surface thereof for separating the outer insulating layer and said at least one conductive layer from said inner insulating layer and said center conductor, said inner insulating layer and center conductor extending through said distal barrel portion; and a rotating nut proximally attached to said hollow inner post, in which the rotating nut, hollow inner post, and outer tubular sleeve are preassembled as a one piece connector, and in which said inner post and rotating nut are axially movable toward the distal end of said tubular sleeve in order to crimp an inserted cable end.

As opposed to prior art coaxial cable connectors referred to above, the coaxial cable connector according to the present invention operates such that the outer body of the connector where the cable entry port is located remains stationary. The post and the tubular nut are axially driven, using a conventional termination tool, toward the rear of the connector body in which the cable entry port is located.

An advantage provided by the present coaxial cable connector is that fewer parts are required in comparison with many known F connectors manufactured for this purpose. Moreover, the connector is provided as a single component to the user in which closure of the connector completes the assembly after a cable end is inserted. No additional external components are required. Therefore, manufacture of the present coaxial cable connector is simpler, less expensive and far less labor intensive.

Another advantage is that the coaxial cable connector of the present invention can be used in conditions normally requiring either environmental or non-environmental type connectors, allowing greater versatility and flexibility.

Another advantage is that an effective 360 degree seal is produced for the separated as well as the unseparated portions of the coaxial cable which is terminated after a termination tool is used to push the cable/connector assembly together. The seal is effective for both moisture and RF leakage.

Yet another advantage of the connector of the present invention is that the termination is performed longitudinally, yet in a direction which is opposite to the direction of cable assembly. The post is internal to the sleeve such that all of the sealing is internal to the connector. According to the invention, the rotating nut and inner post are driven toward the cable receiving end of the sleeve which is held stationary. This form of assembly permits greater assurance that the cable will not be loosened.

These and other objects, features, and advantages will herein be described in greater detail in the following Detailed Description which should be read in conjunction with the accompanying drawings.

DETAILED DESCRIPTION

The following description relates to a method for terminating a drop coaxial cable using an F-type cable connector which is made in accordance with certain preferred embodiments of the present invention. Throughout the course of discussion which follows, several terms such as "front", "back", "lateral", "distal" and "proximal" are used to provide a frame of reference with respect to the accompanying drawings. These terms, however, should not be deemed to be limiting of the inventive concepts of the present invention.

Figure 1:
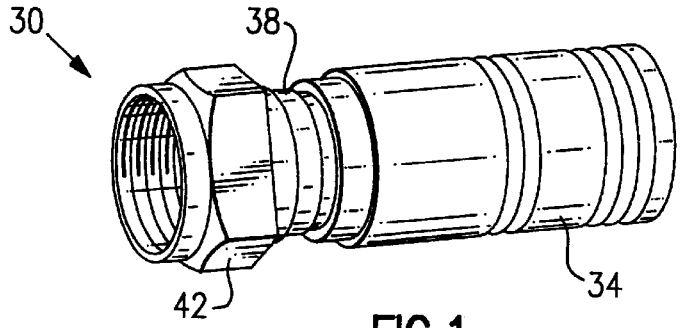
FIG. 1 is a perspective view of an F-type coaxial cable connector made in accordance with a preferred embodiment of the present invention.

Referring to the Figs. and more particularly to FIG. 1, there is first shown a coaxial cable connector according to a preferred embodiment of the present invention. The coaxial cable connector 30 includes three (3) major components; namely an outer tubular sleeve 34, an inner post 38, and a rotating nut 42. The connector 30 shown in this view is preassembled; that is, in the condition a user would typically receive the connector from the factory prior to desired cable termination. Both the preassembly of the cable connector and the method of terminating a drop end of a coaxial cable using the connector are herein described below.

Figure 2:
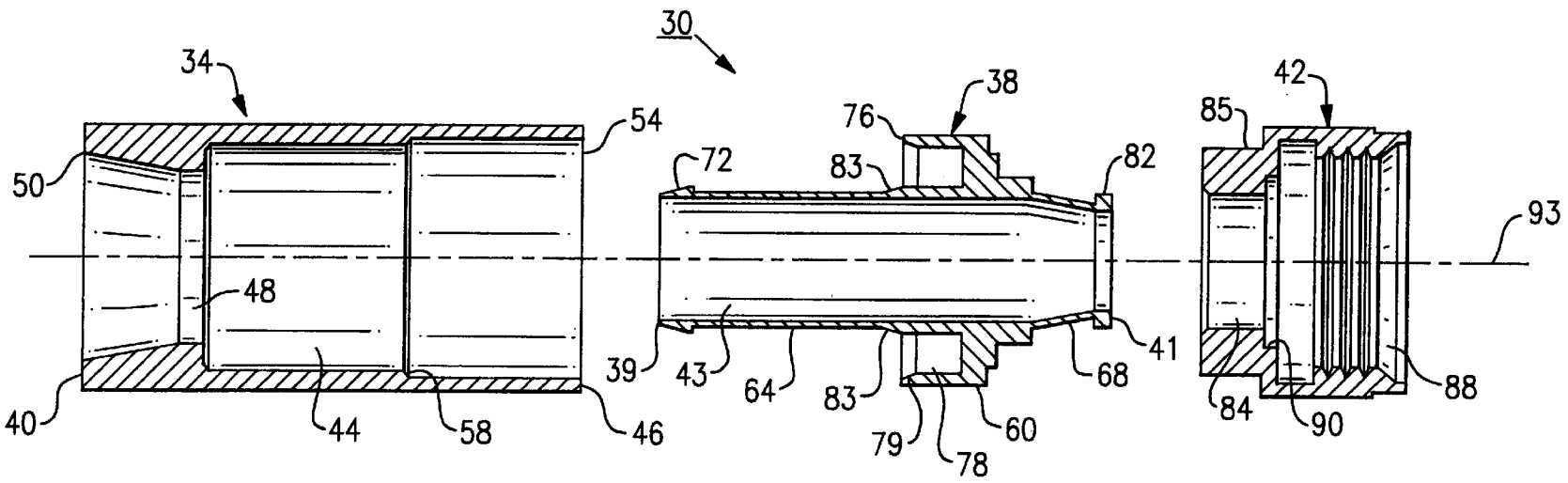
FIG. 2 is an exploded view, taken in section of the coaxial cable connector of FIG. 1.

First, however, and referring to FIG. 2, an exploded view of the coaxial cable connector 30 more clearly illustrates the above noted components. The outer tubular sleeve 34 is a cylindrical member having a pair of open ends 40, 46 defining a hollow interior 44. The distal end 40 of the tubular sleeve 34 includes an inwardly tapering opening 50 which terminates a predetermined axial distance into the sleeve at a narrowed section or throat 48. The proximal end 46 of the sleeve 34 includes an opening 54 having a diameter which is larger than the distal opening 50, the hollow interior 44 further having an annular shoulder or ridge 58 disposed a predetermined axial distance from the proximal end 46.

The inner post 38, like the outer tubular sleeve 34, is defined by a pair of open ends 39, 41, and a hollow interior 43. More particularly, the inner post 38 includes an annular flange 60 having a distal barrel portion 64 and a proximal fastening portion 68 extending respectively therefrom. The distal barrel portion 64 includes a raised barb 72 at the distal end 39 which tapers outwardly from the open end to a flattened portion 74, shown most clearly in FIGS. 3–5. The annular flange 60 includes a distal facing surface 76 having a circumferential recess 78 including an inwardly tapering surface 79 leading to a rectangular shaped slot. The barrel section 64 also includes an outwardly tapered surface 83 extending into the circumferential recess 78. The proximal fastening portion 68 is defined by an inwardly tapering cylindrical section having an annular tab 82 at the proximal end 41 of the post 38.

The rotating nut 42 includes a distal engagement portion 85 having an opening 84 sized for receiving the proximal fastening section 68 of the post 38. The nut 42 further includes a female receiving portion 88 for receiving the input end (not shown) of a cable transmission device which is interiorly threaded, the female receiving portion being separated from the receiving opening 84 of the distal engagement portion 85 by an annular recess 90. According to the preferred embodiment, each of the three major components are made from the same material (e.g. brass), though it will be readily apparent that suitable material variations can be substituted. As shown, each of the three major components are longitudinally aligned along an assembly axis 93.

With the preceding background, the preassembly of the coaxial cable connector 30 will now be described with reference to FIGS. 3–5. Initially, and as shown in FIG. 3, the proximal fastening portion 68 of the inner post 38 is inserted into the receiving opening 84 of the rotating nut 42 until an exposed end 98 of the distal engagement portion 85 engages an edge 96 at the proximal end of the annular flange 60 of the post which prevents further axial movement.

Figure 3:
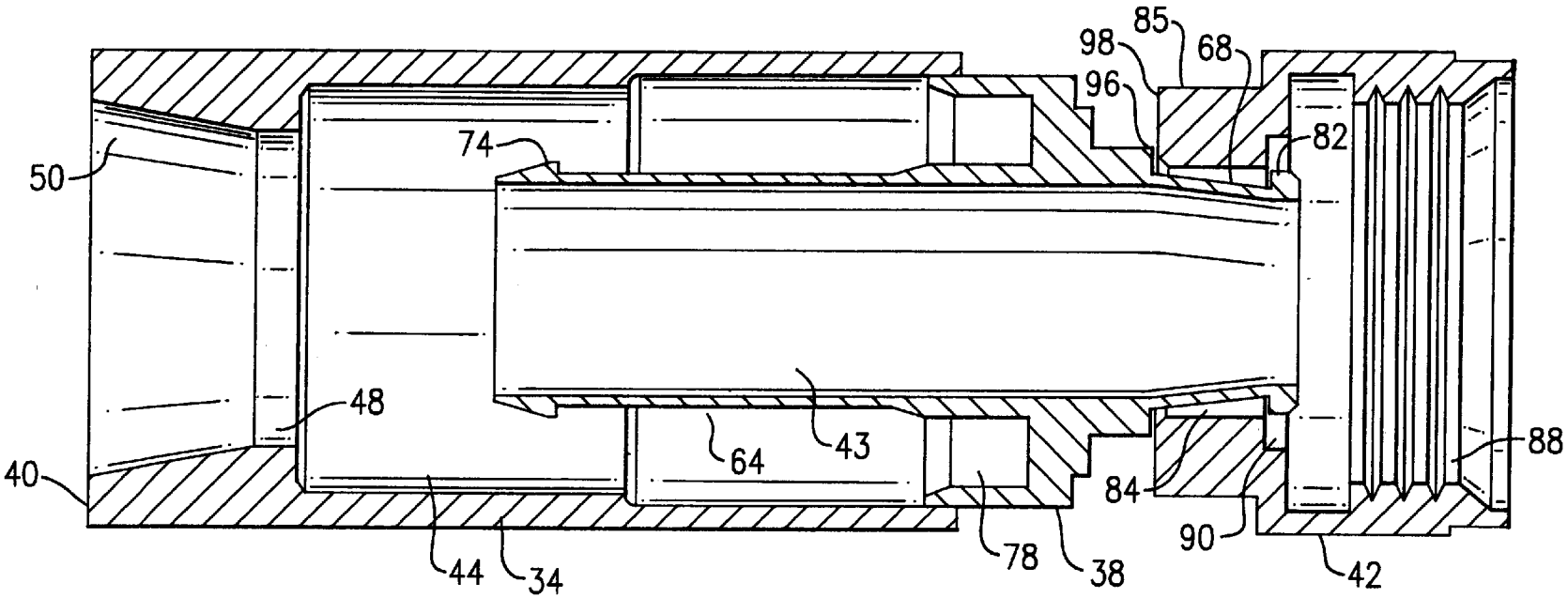
FIG. 3 is a sectional view of the coaxial cable connector of FIGS. 1 and 2, shown in an initial pre-assembled condition.
Figure 4:
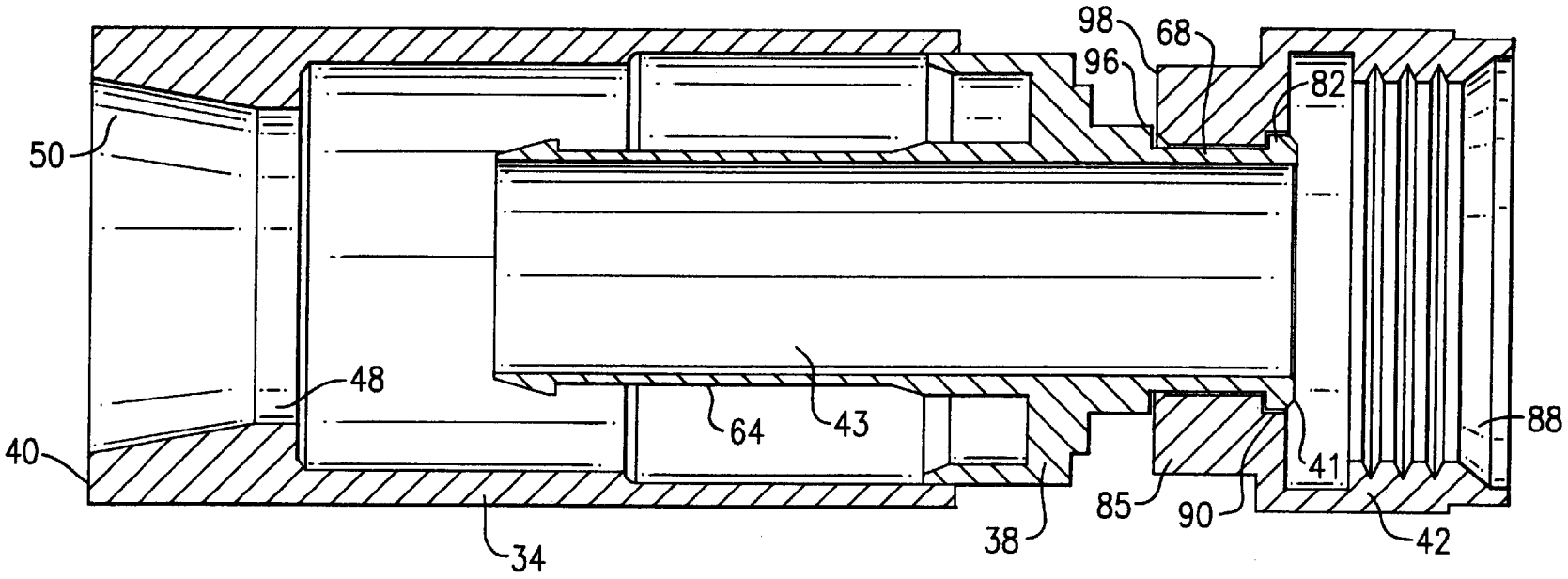
FIG. 4 is the sectional view of FIG. 3, depicting the coaxial cable connector in a partial preassembly condition.

According to FIG. 4, an anvil (not shown) or other device is then inserted into the hollow interior 43 of the inner post 38 and more particularly into the proximal fastening portion 68 causing the tapered cylindrical portion thereof to expand and the annular tab 82 at the proximal end 41 of the post 38 to engage the annular recess 90, the recess being sized to retain the rotating nut 42 into locking engagement. Though the tubular sleeve 34 is shown in FIGS. 3 and 4, this component is not yet necessary for purposes of the described preassembly process.

Figure 5:
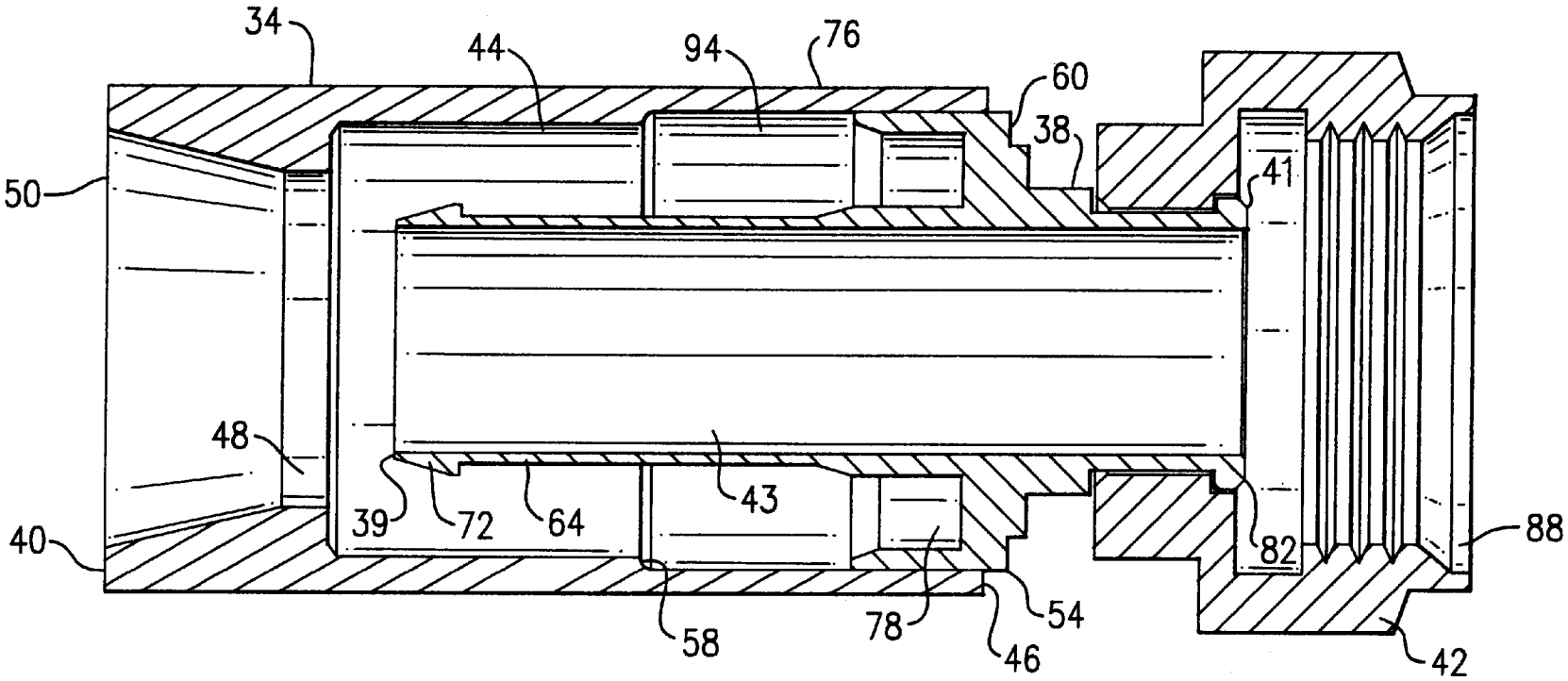
FIG. 5 is the sectional view of FIGS. 3 and 4, depicting the coaxial cable connector in a completed preassembly condition.

With reference to FIG. 5, the formed post/rotating nut assembly of FIGS. 3 and 4 is then pre-assembled to the outer tubular sleeve 34 with the proximal opening 54 of the outer sleeve being sized to allow a press fit of the annular flange 60 of the inner post 38 within the hollow interior 44 of the sleeve. In this embodiment, the inner post 38 is inserted into the proximal end 46 of the outer sleeve 34 to a predetermined axial distance, creating an annular space 94 about the periphery of the barrel section 64 between the distal facing surface 76 of the annular flange 60 and the throat 48. In a preferred preassembly, the barrel portion 64 of the inner post 38 is aligned with the distal opening 50 of the tubular sleeve 34 along the axis 93, FIG. 2, and is located or positioned proximally a short axial distance from the throat 48.

Figure 6:
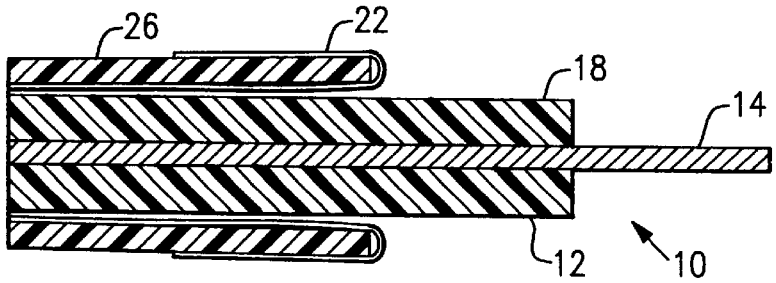
FIG. 6 is a partial sectional view of a coaxial cable as prepared prior to insertion into the coaxial cable connector of the present invention.

Before discussion of the termination process using a cable connector as described above, reference is now made to FIG. 6 which illustrates a prepared end portion of a coaxial cable 10. More particularly, the coaxial cable 10 includes a center electrical conductor 14, such as copper or a copper-clad steel, and a foam dielectric layer 18, which surrounds the center electrical conductor. A conductive braid 22, such as aluminum, is disposed about the foam dielectric layer 18, while an insulating outer elastomeric jacket 26 completes the coaxial cable assembly. Alternately, a conductive foil (not shown) can be included in lieu of or in combination with the conductive braid 22. Each of the above components and cable manufacture are commonly known and require no further discussion.

In preparing the end portion of the coaxial cable 10, a predetermined axial portion (typically on the order of about 0.25 inches each) of the center electrical conductor 14 and the foam dielectric layer 18 are sequentially exposed from the remaining layers 22, 26 of the cable. A portion of conductive braid 22 is wrapped about the outer jacket end. As shown in the FIG. 6, the center electrical conductor 14 extends relative to the end of the dielectric layer 18, with an axial portion of the dielectric layer extending coextensively from the jacket 26 and the wrapped braid 22. Each of the preceding preparation steps are commonly known in the field.

Referring to FIGS. 7–10, a cable termination end assembly is now described in conjunction with the prepared cable 10 and a coaxial cable connector 10A manufactured according to a second embodiment of the present invention. In brief, the coaxial cable connector 30A, like the preceding version, includes an outer tubular sleeve 34A having an interior 44A and a narrowed throat 48A disposed in relation to a distal end 40A. Within the outer tubular sleeve 34A is an inner post 38A defined by an annular flange 60A with an extending barrel section 64A and proximal fastening portion 68A. The proximal fastening portion 68A is attached though a receiving opening 84A of a distal engagement portion 85A of rotating nut 42A and the resulting rotating nut/inner post subassembly is pressfitted a predetermined axial distance into the hollow interior of the outer tubular sleeve in a manner as described according to the preassembly procedure detailed above.

The most noteworthy differences between these embodiments are the exclusion of the tapered cylindrical section and annular tab of the proximal fastening portion 68A, and an increased axial length of the raised barb 72A defined on the barrel section 64A. The termination method herein described, however, is performed in the same manner and according to the same steps using either type connector, as will be readily apparent. For purposes of discussion herein, the above connector further includes a pair of O-rings 104, 108 or other sealing members which are disposed between the inner post 38A and the distal engagement portion of the rotating nut 42A and within the female receiving portion 88A, respectively. The O-rings 104,108 are each made from an elastomeric material, such as an ethylene propylene, or other resilient material which is resistant to ozone.

Figure 7:
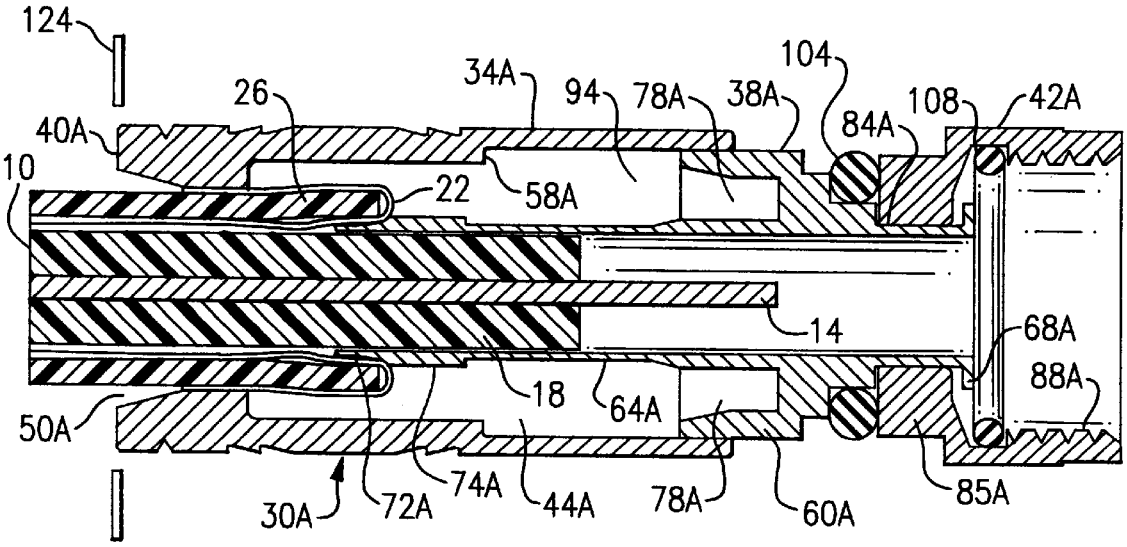
FIG. 7 is a partial sectional view of the prepared coaxial cable end of FIG. 6 as initially inserted into a preassembled coaxial cable connector made in accordance with a second embodiment of the present invention.

Referring to FIG. 7, the prepared end portion of the coaxial cable 10 is initially inserted into the tapered distal opening 50A of the distal end 40A of the preassembled cable connector 30A. Upon insertion thereof, the exposed portions 14, 18 of the cable 10 easily pass through the tapered distal opening 50A of the outer tubular sleeve 34A. The outer portions 22, 26 of the cable 10, however, are compressed due to the constrictive cross section of the narrowed throat 48A. According to this embodiment, an average compression of about 16–20 percent is achieved. The exposed portions of the center electrical connector 14 and the dielectric layer 18 pass into the aligned hollow opening of the distal barrel portion 60A with the outer sleeve 26 and the conductive braid 22 being separated from the remainder of the cable 10 by the raised barb 72A into the annular space 94 defined between the barrel portion 64A and the interior side of the outer tubular sleeve 34A. The barb 72A creates a stretching of the conductive braid and outer jacket. Therefore a slight force is required for insertion of the cable, but in that separation requires a much greater force to withdraw the jacket and braid from the connector. Moreover, the above stretching creates a new larger diameter for the separated jacket and braid so that a mechanical interference or crimp will result when the barb and throat are planarly aligned as described below upon "closing" the connector.

The separation of the outer layers 22, 26 of the cable 10 and the narrowed throat 48A further provides a locking force which does not easily permit the separation of the cable from the connector once the cable has been initially inserted as described.

Figure 8:
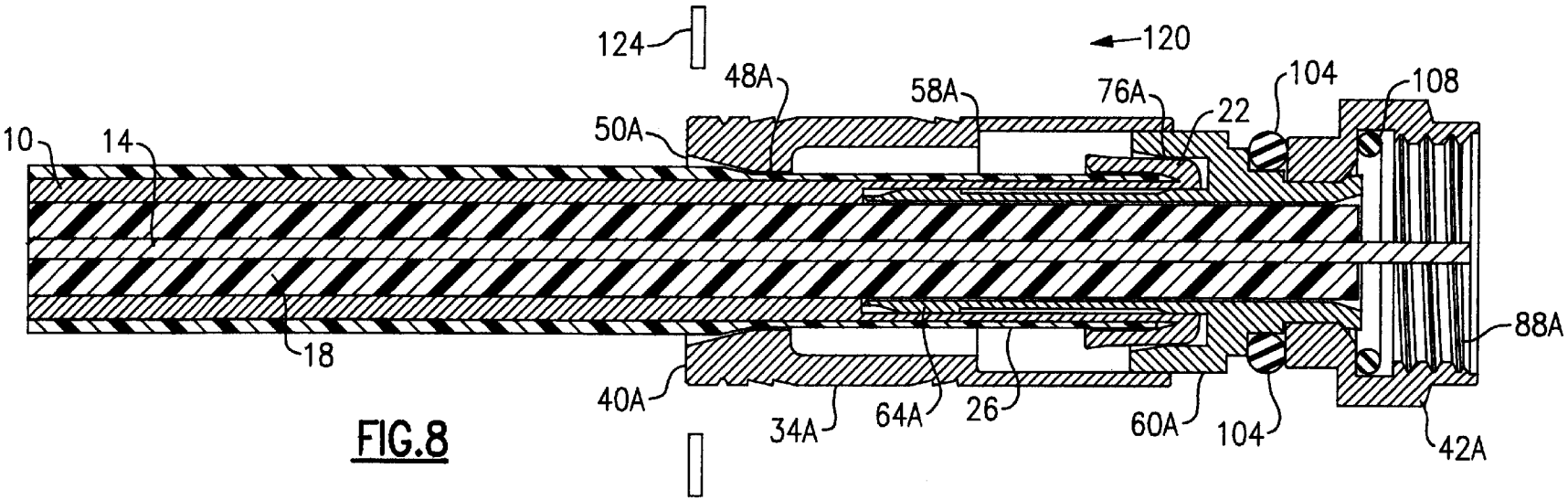
FIG. 8 is the partial sectional view of FIG. 7 with the prepared coaxial cable end fully inserted into the cable connector.

Referring to FIG. 8, further axial insertion of the cable 10 causes the wrapped end, including the separated portions of the outerjacket 26 and conductive braid 22, to engage the circumferential recess 78A on the distal facing surface 76A of the annular flange 60A of the inner post 38A. The above steps initially position and secure the end portion of the coaxial cable 10 within the connector 30A and the connector is now ready for termination.

Figure 10:
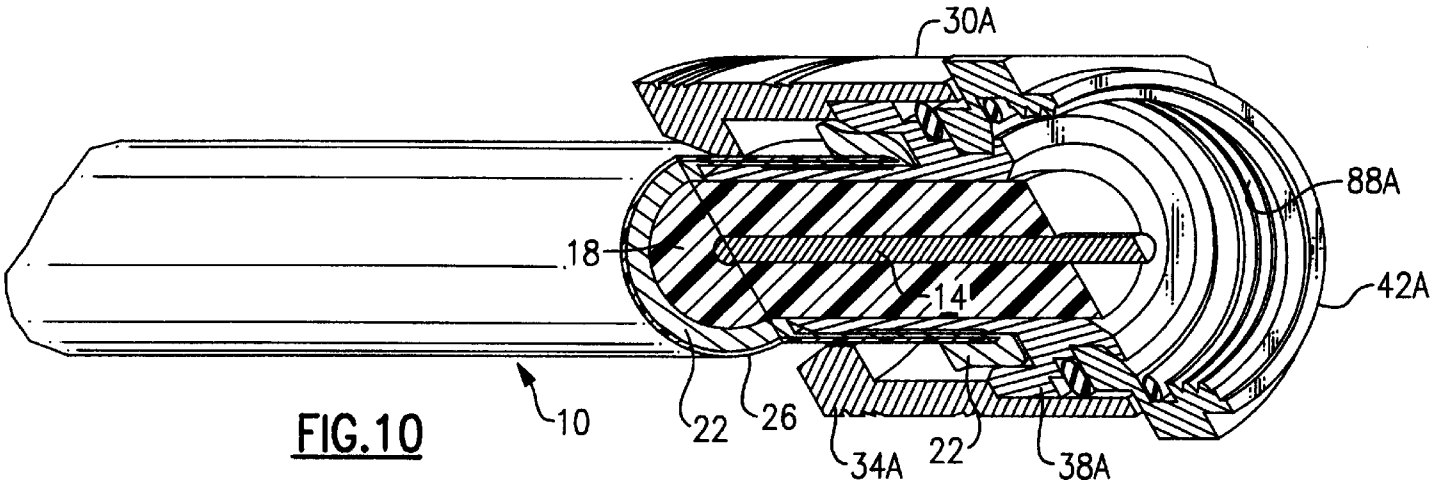
FIG. 10 is a partially cutaway perspective view of a completed coaxial cable/cable connector assembly.
Figure 9:
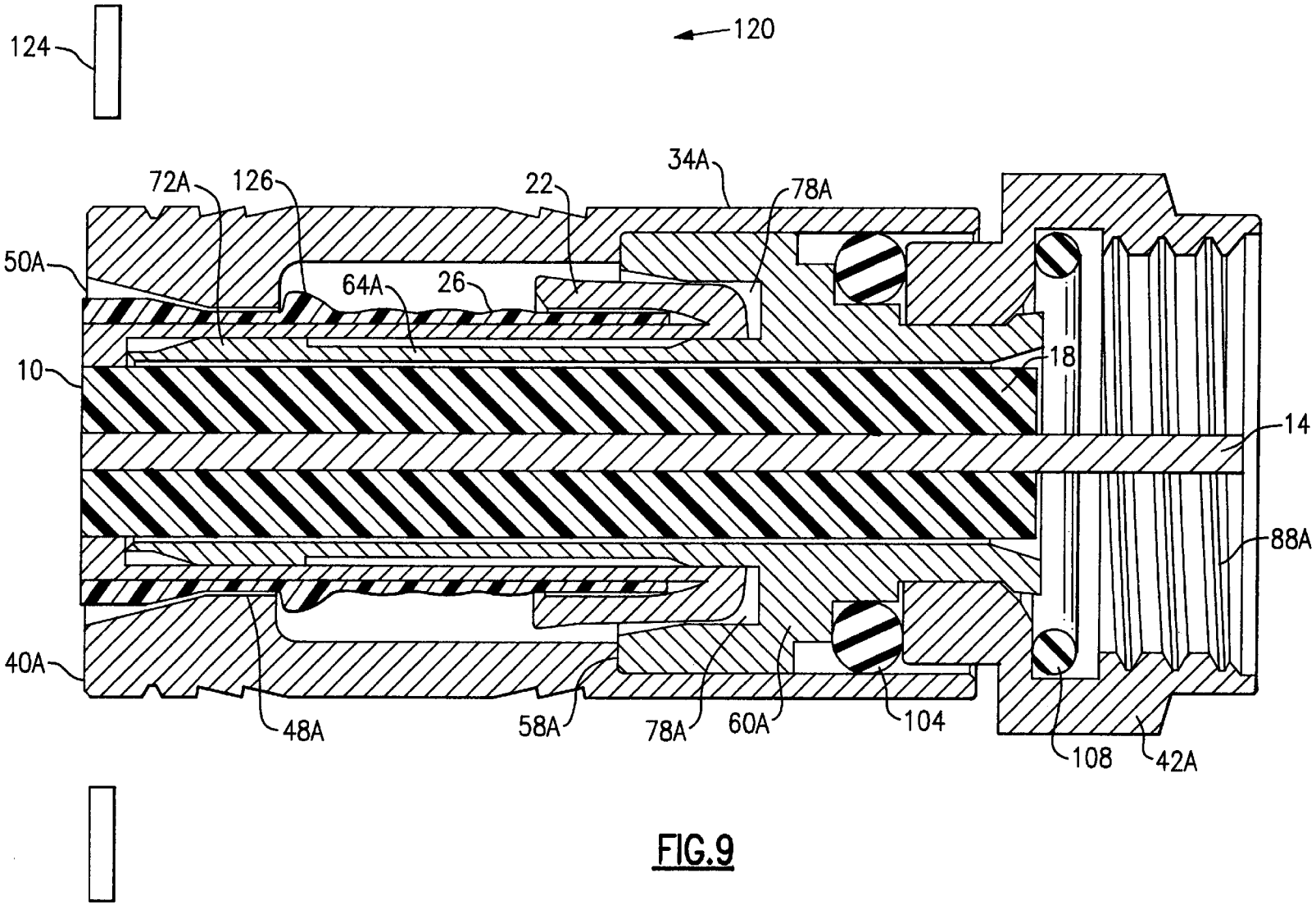
FIG. 9 is the partial sectional view of FIGS. 7 and 8 showing the completion of the cable/coaxial cable connector assembly process.

Referring to FIGS. 9 and 10, a hand-held or other longitudinal crimping tool (not shown) is then used to engage the rotating nut 42A and the inner post 38A, while retaining the outer sleeve 34A in a stationary position through support herein indicated pictorially by 124. Longitudinal crimping tools are known in the field and do not form an essential part of the present invention. Therefore, details regarding these tools are not required other than to note that modification of these tools is not required in order to terminate using the above connector 30A.

The inner post/rotating nut assembly is longitudinally driven in an axial direction 120 toward the distal end 40A of the outer tubular sleeve 34A, the sleeve as noted above being stationarily held in fixed relation by the tool. The cable end resists loosening when pushed by the inner post in the above direction 120, due mainly to the attachment of the separated layer ends in the circumferential recess 76A, the retention of the exposed dielectric layer 18 and center electrical conductor 14 in the hollow interior of the barrel portion 64A, and the radial compressive force exerted by the throat 48A. In fact, a portion 126 of the separated layers 22, 26 are axially displaced within the annular space 94 defined within the connector due to the compressive force applied by the inner post 38A against the support 124. This displacement creates a thicker massing of the outer jacket and braid, which in turn creates coupling for the cable within the connector.

The annular shoulder or ridge 58A along the inner surface of the outer tubular sleeve 34A provides an axial stop for the post/rotating nut subassembly to prevent further longitudinal movement thereof. In this position, the end of the exposed center electrical connector 14 is axially disposed in the female receiving portion of the rotating nut while the raised barb of the barrel portion 60A is substantially in the throat 48A, aiding the seal in the distal end of the connector. In the final crimped position, the cable end is securely maintained within the connector 30A with greater confidence that the cable 10 has been properly seated with the facing surface of the inner post 38A assuring a solid electrical connection without the presence of leakage paths. Moreover, O-rings 104 and 108 provide additional seal protection if the connectors are to be used as environmental connectors.

Parts List FIGS. 1–10

| | |
|---|---|
| 10 | coaxial cable |
| 11 | cable end |
| 14 | center electrical connector |
| 18 | dielectric layer |
| 22 | conductive braid |
| 26 | outer jacket |
| 30 | cable connector |
| 34 | outer tubular sleeve |
| 38 | inner post |
| 39 | distal end - post |
| 40 | distal end - sleeve |
| 41 | proximal end - post |
| 42 | rotating nut |
| 43 | interior |
| 44 | interior |
| 46 | proximal end |
| 48 | throat |
| 50 | tapered opening |
| 54 | proximal opening |
| 58 | annular shoulder or ridge |
| 60 | annular flange |
| 64 | distal barrel portion |
| 68 | nut fastening portion |
| 72 | raised barb |
| 74 | flattened portion |
| 76 | facing surface |
| 78 | circumferential recess |
| 79 | inwardly tapering surface |
| 82 | annular tab |
| 83 | tapered surface |
| 84 | distal opening |
| 85 | distal engagement portion |
| 88 | receiving portion |
| 90 | annular recess |
| 92 | edge |
| 93 | assembly axis |
| 94 | annular space |
| 104 | O-ring |
| 108 | O-ring |
| 120 | axial direction |
| 124 | support |

-continued

| Parts List FIGS. 1–10 | |
|---|---|
| 126 | compressed layers |
| 30A | cable connector |
| 34A | outer tubular sleeve |
| 38A | inner post |
| 39A | distal end - post |
| 40A | distal end - sleeve |
| 41A | proximal end - post |
| 42A | rotating nut |
| 43A | interior |
| 44A | interior |
| 46A | proximal end |
| 48A | throat |
| 50A | tapered opening |
| 54A | proximal opening |
| 58A | annular shoulder or ridge |
| 60A | annular flange |
| 64A | distal barrel portion |
| 68A | nut fastening portion |
| 72A | raised barb |
| 74A | flattened portion |
| 76A | facing surface |
| 78A | circumferential recess |
| 79A | inwardly tapering surface |
| 83A | tapered surface |
| 84A | distal opening |
| 85A | distal engagement portion |

Though the preceding has been described based on certain preferred embodiments, it will be readily apparent that certain variations and modifications are possible based on the inventive concepts described herein and according to the following claims.

We claim:

1. A longitudinally compressed coaxial cable connector used for terminating a drop end of a coaxial cable, the coaxial cable including a center electrical conductor, a dielectric layer surrounding the center electrical conductor, a conductive layer surrounding the dielectric layer, and an outer insulating layer, said connector comprising:

an outer tubular sleeve having opposing first and second ends;

an inner hollow post pressfitted into one of the ends of said outer tubular sleeve, said inner hollow post comprising an annular flange and an extending barrel portion sized for receiving the dielectric layer and center electrical conductor of a prepared cable end inserted into the other end of said outer tubular sleeve, said barrel portion including a raised barb for expanding and trapping the conductive layer and the outer insulating layer of the inserted cable end; and a rotating nut member attached to said inner post, said rotating nut member having an internal threaded portion for mating with a cable termination device, wherein said inner post, said rotating nut member and said outer tubular sleeve are preassembled as a one piece connector, and, when terminating the drop end of the coaxial cable, said inner post and said rotating nut member are axially movable within the interior of said outer tubular sleeve from a preassembly position to a second assembled position toward the cable receiving end of the outer tubular sleeve to compress the inserted cable end and to complete the termination thereof.

2. A cable connector as claimed in claim 1, wherein said outer tubular sleeve includes a stop for preventing additional axial movement of said inner post and said rotating nut member toward the cable receiving end of said outer tubular sleeve beyond the second assembled position.

3. A cable connector as claimed in claim 1, wherein the end of said outer tubular sleeve receiving said prepared cable end includes an opening having a narrowed throat.

4. A cable connector as claimed in claim 1, wherein said inner post includes a nut fastening portion disposed oppositely from said barrel portion relative to the annular flange, said rotating nut member having an engagement portion including an opening for receiving said nut fastening portion.

5. A cable connector as claimed in claim 4, wherein said nut fastening portion includes a radially expandable cylindrical section having an annular rib at an extended end thereof, said rotating nut member including a recess sized for retaining the annular rib when said cylindrical section is expanded to lock the rotating nut member to said inner post.

6. A cable connector as claimed in claim 3, wherein said raised barb is disposed at an extending end of said barrel portion.

7. A cable connector as claimed in claim 6, wherein said raised barb is initially axially disposed proximally of said throat prior to cable insertion and said raised barb is disposed substantially in said throat after said inner post and said rotating nut member have been moved toward said cable receiving end of said outer tubular sleeve.

8. A cable connector as recited in claim 1, wherein said annular flange includes a distal facing surface facing said cable receiving end of said outer tubular sleeve, said distal facing surface including a circumferential recess for receiving separated portions of the inserted cable end.

9. A cable connector as recited in claim 1, including at least one sealing member disposed between said rotating nut and the nut fastening portion of said inner hollow post.

10. A cable connector as claimed in claim 1, wherein said rotating nut member is attached only to said inner post.

11. A longitudinally compressed coaxial cable connector used for terminating a drop end of a coaxial cable, the coaxial cable including a center electrical conductor, a dielectric layer surrounding the center electrical conductor, a conductive layer surrounding the dielectric layer, and an outer insulating layer, said connector comprising:

an outer tubular sleeve having opposing first and second ends;

an inner hollow post pressfitted into one of the ends of said outer tubular sleeve, said inner hollow post comprising an annular flange and an extending barrel portion sized for receiving the dielectric layer and center electrical conductor of a prepared cable end inserted into the other end of said outer tubular sleeve, said barrel portion including a raised barb for expanding and trapping the conductive layer and the outer insulating layer of the inserted cable end, said annular flange including a distal facing surface facing said other end of said outer tubular sleeve, said distal facing surface including a circumferential recess for receiving separated portions of the inserted cable end;

a rotating nut member attached to said inner post, said rotating nut member having an internal threaded portion for mating with a cable termination device, wherein said inner post, said rotating nut member and said outer tubular sleeve are preassembled as a one piece connector, and in which said inner post and said rotating nut member are axially movable within the interior of said outer tubular sleeve from a preassembly position to a second assembled position toward the cable receiving end of the outer tubular sleeve to compress the inserted cable end and to complete the termination thereof.

12. A longitudinally compressed cable connector for terminating a drop end of a coaxial cable, said connector comprising:

an outer tubular sleeve having opposing first and second ends;

a hollow inner post pressfitted into one of the ends of the outer tubular sleeve, said inner post comprising an annular flange and an extending barrel portion having a diameter sized for receiving a portion of a prepared coaxial cable end inserted into the opposing end of said tubular sleeve, said barrel portion having means for separating portions of said coaxial cable; and a rotating nut fixedly attached to said inner post, said rotating nut having an internal threaded portion mating with a cable termination device, wherein, when terminating a drop end of a coaxial cable, said rotating nut and inner post move axially in a direction directed toward the cable receiving end of the outer tubular sleeve, said sleeve being stationarily held after insertion of said cable end and in which said outer tubular sleeve includes an opening at the cable receiving end, said opening having a throat for compressing said inserted cable end.

13. A cable connector as claimed in claim 12, wherein said inner post includes a nut fastening portion disposed oppositely from said barrel portion relative to the annular flange, said rotating nut having an engagement portion including an opening for receiving said nut fastening portion.

14. A cable connector as claimed in claim 13, wherein said nut fastening portion includes a radially expandable cylindrical section having an annular rib at an extended end thereof, said rotating nut including a recess for retaining the annular rib when said cylindrical section is expanded to lock the rotating nut to said inner hollow post.

15. A cable connector as claimed in claim 12, wherein said cable separating means includes a raised barb provided on the exterior of said extending barrel portion.

16. A cable connector as claimed in claim 15, wherein said raised barb is disposed at an extending end of said barrel portion.

17. A cable connector as recited in claim 16, wherein said inner post is initially axially disposed within said outer tubular sleeve prior to crimping such that said raised barb is proximally disposed relative to said throat.

18. A cable connector as recited in claim 17, wherein said outer tubular sleeve includes an axial stop disposed within said sleeve for preventing movement of said inner post and rotating nut beyond a predetermined axial distance to allow the raised barb to be positioned substantially in said throat.

19. A cable connector as claimed in claim 12, wherein said inner post includes a distal facing surface facing the cable receiving end of said outer tubular sleeve, said distal facing surface including a circumferential recess for receiving separated portions of said cable.

20. A cable connector as claimed in claim 12, including at least one sealing member disposed between the rotating nut and the inner post.

21. A method of terminating a coaxial cable using an F connector, said F connector having an inner post, an outer tubular sleeve and a rotating nut, each of which are attached forming a one piece connector, said method comprising the steps of:

i) preparing an axial end of a coaxial cable by removing at least one outer layer of the cable;

ii) inserting the prepared coaxial cable end into one end of said outer tubular sleeve of said cable connector wherein insertion of the cable end causes an inner portion of the axial end of the cable to extend through an axial sleeve of said inner post and separates outer layers of the remainder of the cable inserted into the connector;

iii) inserting the cable until the separated ends thereof engage a circumferential recess formed on said inner post; and iv) supporting said outer tubular sleeve in a stationary position and axially driving the inner post and rotating nut within said outer tubular sleeve toward the end thereof which received the cable end in order to compress the cable.

22. An assembly comprising a coaxial cable and a cable connector, said coaxial cable including:

a center conductor;

an inner insulating layer surrounding said center conductor;

at least one outer conductive layer surrounding said inner insulating layer; and an outer insulating jacket surrounding said at least one outer conductive layer, said cable connector comprising:

an outer tubular sleeve;

a hollow inner post pressfitted in said outer tubular sleeve, said hollow inner post having an annular flange and a distal barrel portion extending from said annular flange having a diameter which is smaller than the diameter of the inner conductive layer, said distal barrel portion further having a raised barb on an exterior surface thereof for separating the outer insulating layer and said at least one conductive layer from said inner insulating layer and said center conductor, said inner insulating layer and center conductor extending through said distal barrel portion; and a rotating nut proximally attached to said hollow inner post, in which the rotating nut, hollow inner post, and outer tubular sleeve are preassembled as a one piece connector, and, when terminating an end of the coaxial cable, said inner post and rotating nut are axially movable within said outer tubular sleeve toward the distal end thereof in order to crimp the inserted cable end.

23. The combination of claim 22, wherein said inner post includes an annular flange having means for receiving ends of the separated at least one outer conductive layer and outer insulating layer of the coaxial cable.

24. The combination of claim 22, including seal means for sealing the interior of the cable connector.

25. A cable connector as claimed in claim 1, wherein an axial length of said outer tubular sleeve is the same before and after terminating a drop end of the coaxial cable.

26. A longitudinally compressed cable connector for terminating a drop end of a coaxial cable, said connector comprising:

an outer tubular sleeve having opposing first and second ends;

a hollow inner post pressfitted into one of the ends of the outer tubular sleeve, said inner post comprising an annular flange and an extending barrel portion having a diameter sized for receiving a portion of a prepared coaxial cable end inserted into the opposing end of said tubular sleeve, said barrel portion having means for separating portions of the coaxial cable, said inner post including a distal facing surface facing said opposing end of said outer tubular sleeve, said distal facing surface including a circumferential recess for receiving separated portions of the cable; and a rotating nut fixedly attached to said inner post, said rotating nut having an internal threaded portion mating with a cable termination device, wherein said rotating nut and inner post are capable of axial movement in a direction directed toward the cable receiving end of the outer tubular sleeve, said sleeve being stationarily held after insertion of said cable end and in which said outer tubular sleeve includes an opening at the cable receiving end, said opening having a throat for compressing said inserted cable end.

* * * * *